United States Patent [19]

Bayuk

[11] Patent Number: 4,674,723

[45] Date of Patent: Jun. 23, 1987

[54] ADJUSTABLE SHELF ASSEMBLY

[76] Inventor: Robert Bayuk, 12 Hillside Dr., Annandale, N.J. 08801

[21] Appl. No.: 752,848

[22] Filed: Jul. 8, 1985

[51] Int. Cl.[4] ..... E04G 3/08

[52] U.S. Cl. ..... 248/246; 248/247

[58] Field of Search ..... 248/246, 244, 245, 243, 248/544, 300, 248, 247, 250; 108/108; 211/103, 90, 193; 29/700

[56] References Cited

U.S. PATENT DOCUMENTS

| | | | |
|---|---|---|---|
| 866,695 | 9/1907 | Taussig . | |
| 1,041,264 | 10/1912 | Freud . | |
| 2,674,431 | 4/1954 | Attwood . | |
| 2,703,692 | 3/1955 | Felix | 248/244 |
| 3,351,313 | 11/1967 | Guillon | 248/246 |
| 3,664,627 | 5/1972 | Sykes et al. . | |
| 3,710,734 | 1/1973 | Bofferding et al. | 248/246 X |
| 3,730,468 | 5/1973 | Magnusen . | |
| 4,033,540 | 7/1977 | Hamblin . | |
| 4,156,515 | 5/1979 | Mochly . | |
| 4,170,335 | 10/1979 | King | 248/246 |
| 4,299,368 | 11/1981 | Winkler | 248/246 |

FOREIGN PATENT DOCUMENTS

| | | | |
|---|---|---|---|
| 0033504 | 11/1964 | Finland | 248/246 |

*Primary Examiner*—Ramon O. Ramirez

*Attorney, Agent, or Firm*—Cousins & Cousins

[57] ABSTRACT

Disclosed is a shelf support construction including an elongated, rigid, hollow, box channel adapted for attachment to a wall or other surface which is normally vertically positioned with an open slot to receive a shelf support bracket. The bracket has a rear portion engageable in the interior of the box channel and terminating in fingers alternately bent to the right and to the left of the bracket's plane, to grip the inner side walls of the channel. Projecting stops are formed on the fingers to bear against the flanges defining the slot to prevent dislodgement of the bracket from the channel. An adjusting sleeve is provided which slides on the bracket to compress the fingers into locked and unlocked positions relative to the channel when it is desired to change the position of the bracket on the channel or effect its removal by sliding same out of the channel from its open upper or lower end. The ends of the fingers can be serrated to engage the inner side walls of the channel.

5 Claims, 6 Drawing Figures

ADJUSTABLE SHELF ASSEMBLY

FIELD OF THE INVENTION

This invention relates to low cost adjustable shelf support structures suitable for attachment to a wall or partition and adapted to receive a shelf for decorative or storage purposes. Shelf support structures of this type generally consist of two or more elongated upright rod-like supports, which are secured to a wall and two or more outwardly extending brackets, engageable with said upright supports, upon which brackets the shelf members are placed or attached. Some means for adjusting the location of the brackets upon the rod-like supports is usually provided to add more versatility to the support structures. In a very competitive market, economy of manufacture, materials, ease of assembly, ease of adjustability and speed of installation as well as appearance are important.

DESCRIPTION OF PRIOR DISCLOSURES

The prior art to which this invention relates is aware of the following U.S. patents, U.S. Pat. Nos. 866,695; 1,041,246; 2,674,431; 3,664,627; 3,730,468; 4,033,540 and 4,165,515. The first of these discloses an adjusting shelving support composed of pilasters having a central longitudinal groove against which bears a friction shoe attached to the inner end of a bracket by a bolt and wing nut. U.S. Pat. No. 1,041,264 desribes the combination with a dovetailed grooved upright of an arm having a helical cam to limit the turning of a securing head. U.S. Pat. No. 2,674,431 describes shelving with uprights having a series of spaced open slots and flanges extending inwardly of channels into the slots and which have hooks embracing the flanges. U.S. Pat. No. 3,664,627 refers to a combination where the upright channel member has a lateral projection into which is forced the end of a channel shaped bracket. In U.S. Pat. No. 3,730,468 a furniture support system includes a channel or standard having at least one elongated resilient hook member and means binding at least the edge of a bracket within the resilient member. Retention of the bracket member is accomplished by loading it with a furniture element. U.S. Pat. No. 4,033,540 shows a shelf support with a bracket carrying a pair of wedges disposed within the channel of a standard. The portion of the bracket carrying the wedges is removable from the wedges to allow the bracket and the wedges to be moved lengthwise of the standard. U.S. Pat. No. 4,156,515 describes a "T" shaped wall bracket having a horizontal spike passing into the back wall of a channel member through a slit therein and pressed against the channel rear by the load on the bracket.

As will be seen hereinafter none of these prior art structures in any way suggests or hints at the present novel and unobvious construction.

SUMMARY OF THE INVENTION

The invention therefore comprises a shelf support having an elongated, longitudinally slotted box channel for attachment to a wall with the open slot facing towards a shelf support bracket, said bracket having a shelf-supporting portion and a portion receivable within the slot and terminating in alternately outwardly bent fingers which frictionally grip the inner side walls of the channel. Suitably, projecting stops or tabs stamped in the fingers bear against spaced flanges of the box channel to prevent accidental dislodgement of the bracket from the channel. An adjusting sleeve may be carried by the bracket and can be slid along the bracket toward the channel to press the fingers together and permit the ends to be slid within the inside of the channel to adjust the position of the bracket relative to the channel and to remove or insert the bracket from the channel. Thereafter, the sleeve can be moved away from the fingers to allow them to rapidly spring back and again to frictionally engage the inside of the channel. Preferably, the bracket is formed of a single rigid sheet of metal or durable plastic stamped or cut into a right triangle. Spaced fingers are cut into the bracket at one end and outwardly extending stops are stamped or otherwise formed on the fingers.

Preferably, an adjusting sleeve is permanently and slidably carried by the bracket. However, the sleeve may be separate and slipped on only when needed.

The inner ends of the lowermost finger terminates in serrations or teeth which grip the inner rear wall of the channel, or complimentary serrations thereon.

BRIEF DESCRIPTION OF THE DRAWING

The present invention will be better understood by referring to the accompanying drawings wherein the same reference characters identify the same or like parts throughout the various figures.

In the drawings.

DESCRIPTION OF BEST MODES OF THE INVENTION

Figure 1:
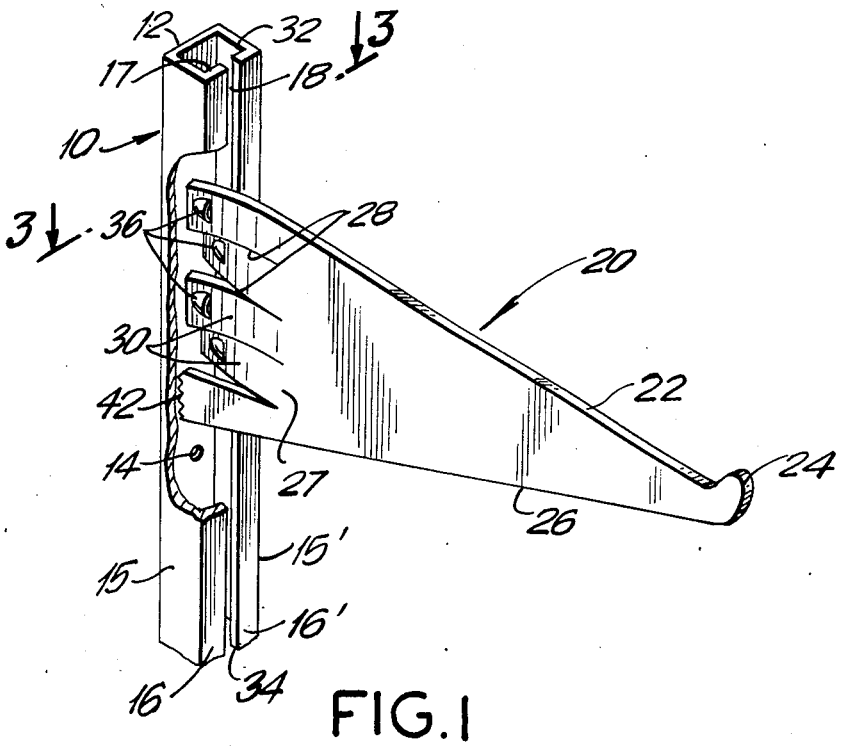
FIG. 1 is a perspective view, partly broken away, of a complete assembly of the invention.

Referring descriptively to the drawing and particularly to FIG. 1, the adjustable shelf construction of the invention comprises an elongated box channel 10, which may be formed of steel or aluminum or by rolling, extrusion, casting, or molding (if made of plastic) and having a rear wall 12 provided with spaced holes 14 for attachment to a wall or the like. Channel 10 also has two side walls 15,15' and two front walls or flanges 16, 16' defining a slit 18 therebetween. The slit is of substantially the same width throughout its length and of a size to freely receive a bracket 20. As shown, box channel 10 is intended to be secured vertically, but may be secured in other inclined positions or even horizontally.

Figure 2:
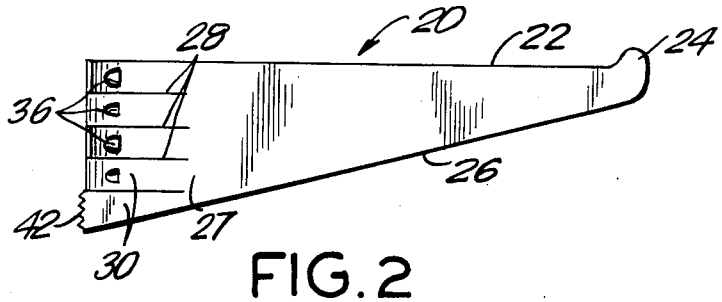
FIG. 2 is a view in side elevation of a bracket blank, usefull in the present invention.

The shelf support bracket 20 of somewhat right triangular shape, also formed of metal or plastic, is of substantially uniform thickness along the greater part of its length and has one edge 22 thereof (hereinafter the upper edge 22) terminating in a hook or stop 24 at its outer or free end. The stop is integral with the bracket 20 and merges into the lower portion 26 of the bracket. On the inner, or wider end 27 of the bracket 20 are cut a series of spaced slits 28 (FIG. 2) which divide this end into at least two resilient fingers 30. The fingers are bent alternately, one to the right, and the adjoining one to the left of the plane of the bracket 20. These fingers are slipped into the box channel 10 at its open upper end 32 or through slot 18. Bracket 20 can be removed by slipping its fingers out of box channel 10 through the lower end 34 thereof or through the top of slot 18 or between the walls 16, 16' of the slot 18.

Figure 3:
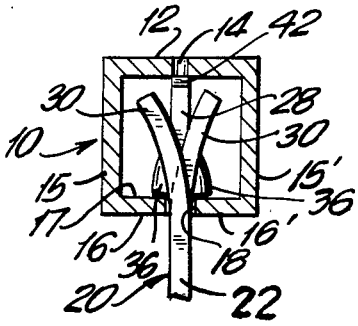
FIG. 3 is a partial, cross-sectional view taken along line 3—3 of FIG. 1.

To prevent accidental dislodgement of bracket 20 from box channel 10 and to provide additional frictional contact, small detents or tabs 36 are struck on the fingers 30 and project outwardly and laterally therefrom to bear against the inner surface 17 of flanges 16, 16' of the box channel support (FIG. 3) when the bracket 20 is in place on the channel.

Figure 5:
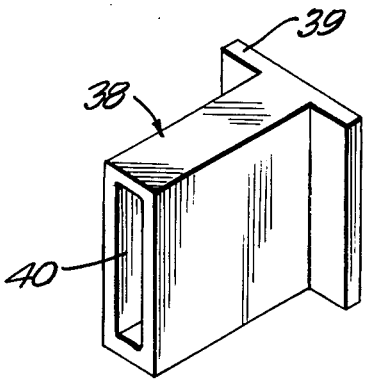
FIG. 5 is a perspective view of an adjusting sleeve according to the invention.
Figure 6:
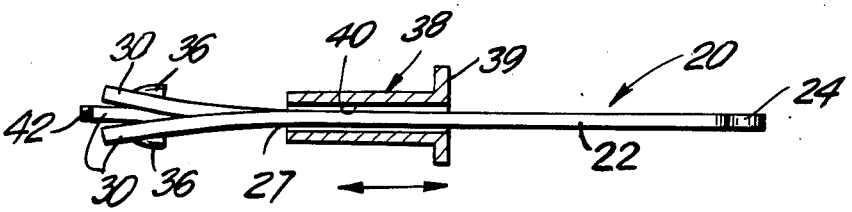
FIG. 6 is a top plan view showing use of the adjusting sleeve on the bracket.

FIGS. 5 and 6 illustrate the structure and operation of an adjusting sleeve 38 used to move bracket 20 along elongated slot 18 and within the box channel 10.

Figure 4:
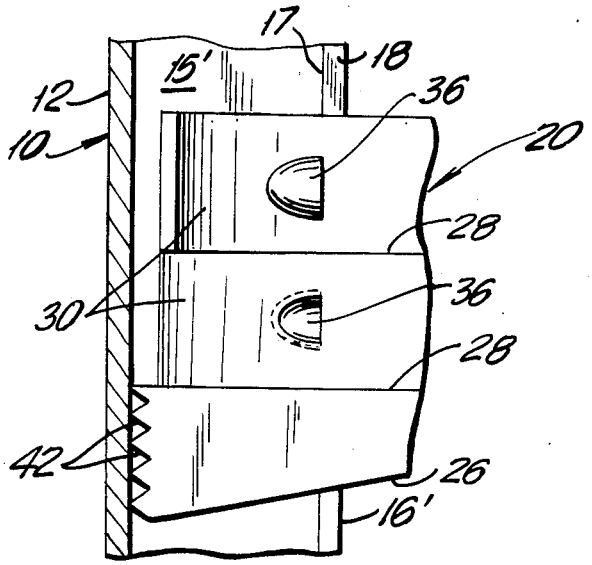
FIG. 4 is a detailed fragmentary view of the inner end of the assembly showing the serrated gripping finger on the bracket.

As shown, adjusting sleeve 38 has a generally rectangular tubular shape. The sleeve is formed of rigid metal or plastic, said member having outwardly extending flange 39 at its outer end and a central opening 40 of a shape and size such as to slide over and along bracket 20 as shown in FIG. 6 to press fingers 30 together and disengage them from the inside surfaces of the box channel 10 to allow the bracket to move vertically within or out of slot 18. When the sleeve 38 is moved away from the fingers 30 by pulling on its flange 39, the fingers will spring apart within the box channel and once again lock the bracket in place. Sleeve 38 can be used for quick release and small adjustments of the bracket's position. The sleeve may be separate from the bracket and slipped on when needed or can be permanently carried thereon.

Where a substantial weight is to be supported by the shelf, the bottom finger 30 of the bracket 20 may be left to lie in the plane of the bracket. Small teeth 42 (best shown in FIGS. 1, 2 and 4) may be cut in the free end of the bottom finger so as to extend in the direction of the rear inner wall surface of the box channel. As the shelf (not shown) is loaded, the teeth 42 will make good locking frictional contact with the channel to prevent any chance of slippage.

It will be understood that a plurality of brackets can be used on each box channel support and that several supports can be used in spaced orientation together with a plurality of brackets to hold shelves.

The one-piece structure of the box channels and the of the brackets in the present invention lend themselves to economical fabrication with no waste of material. In addition, the entire assembly may be achieved without need for tools or fasteners, other than the possible use of the sleeve 38.

Various modifications and alterations to the bracket, box channel support and sleeve may be effected without deviating from the spirit of the invention and the scope of the following claims.

Having thus fully described the invention, what is claimed and desired to be secured by Letters Patent is:

1. An adjustable shelf assembly comprising an elongated, rigid, hollow, box channel supprot member having four walls and open at each end, an elongated slot in one of said walls, said slot dividing said wall into two spaced flange portions, at least one initially planar, one-piece rigid shelf bracket member, said bracket member being of a thickness to be freely and at least partially received within the elongated slot, at least three elongated resilient finger portions struck from the ends of the bracket which is received within the box channel, said fingers being alternately and laterally bent from the plane of the bracket and frictionally engaged with the inside surfaces of the walls of the box channel member, said bracket member being planar with the exception of said bent fingers, a detent struck from each of the fingers and outwardly disposed therefrom to frictionally engage the inner surface of at least one of the flange portions and means for retaining a shelf on said bracket member has been.

2. An assembly according to claim 1 in which the bracket is of a substantially right triangular shape.

3. An assembly according to claim 2 in which the fingers are formed at the widest portion of the bracket.

4. An assembly according to claim 2 in which at least one of the margins of the finger in contact with the interior walls of the box channel member are serrated.

5. An adjustable shelf assembly comprising an elongated, rigid, hollow, box channel support member having four walls and open at each end, an elongated slot in one of said walls, said slot dividing said wall into two spaced flange portions, at least one unitary rigid shelf bracket member, said bracket member being of a thickness to be freely and at least partially received within the elongated slot, a plurality of elongated resilient finger portions struck from the ends of the bracket which is received within the box channel, said fingers being alternately and laterally bent from the plane of the bracket and frictionally engaged with the inside surfaces of the walls of the box channel member, a detent struck from each of the fingers and outwardly disposed therefrom to frictionally engage the inner surface of at least one of the flange portions and an elongated tubular adjusting means slidably carried upon the bracket and adapted to urge the fingers together to release their frictional contact with the interior of the box channel support member.

* * * * *